US010494928B2

(12) United States Patent
Harding et al.

(10) Patent No.: US 10,494,928 B2
(45) Date of Patent: Dec. 3, 2019

(54) COOLED COMPONENT

(71) Applicant: ROLLS-ROYCE PLC, London (GB)

(72) Inventors: Stephen C Harding, Derby (GB); Paul A Hucker, Derby (GB); Nicholas Worth, Derby (GB)

(73) Assignee: ROLLS-ROYCE plc, London (GB)

( * ) Notice: Subject to any disclaimer, the term of this patent is extended or adjusted under 35 U.S.C. 154(b) by 658 days.

(21) Appl. No.: 14/858,490

(22) Filed: Sep. 18, 2015

(65) Prior Publication Data

US 2016/0097285 A1 Apr. 7, 2016

(30) Foreign Application Priority Data

Oct. 6, 2014 (GB) ..... 1417587.1

(51) Int. Cl.
*F01D 5/18* (2006.01)
*F23R 3/00* (2006.01)
*F01D 9/06* (2006.01)

(52) U.S. Cl.
CPC ..... *F01D 5/186* (2013.01); *F01D 9/065* (2013.01); *F23R 3/002* (2013.01); *F23R 3/005* (2013.01);

(Continued)

(58) Field of Classification Search
CPC ..... F01D 5/186; F23R 3/002; F23R 2900/03041; F23R 2900/03042; F05D 2260/202
See application file for complete search history.

(56) References Cited

U.S. PATENT DOCUMENTS 4,669,957 A * 6/1987 Phillips ..... F01D 5/186 415/115
5,528,904 A * 6/1996 Jones ..... F01D 5/288 60/753

(Continued)

FOREIGN PATENT DOCUMENTS

EP 1517003 A2 3/2005
EP 1635119 A2 3/2006

(Continued)

OTHER PUBLICATIONS

Mar. 8, 2016 Extended Search Report issued in European Patent Application No. 15185888.3.

(Continued)

*Primary Examiner* — Arun Goyal
*Assistant Examiner* — Thuyhang N Nguyen
(74) *Attorney, Agent, or Firm* — Oliff PLC

(57) ABSTRACT

A cooled gas turbine engine component comprises a wall which has a plurality of effusion cooling apertures extending there-through from a first surface to a second surface. Each aperture has an inlet in the first surface and an outlet in the second surface. Each aperture has a metering portion and a diffusing portion arranged in flow series and each metering portion is elongate and the width is greater than the length of the metering portion. The metering portion of each aperture has a U-shaped bend. The diffusing portion of each aperture is arranged at an angle to the second surface. Each outlet has a rectangular shape in the second surface of the wall. Each inlet has an elongate shape in the first surface of the wall and the inlet in the wall is arranged substantially diagonally with respect to the outlet in the wall.

34 Claims, 9 Drawing Sheets

(52) U.S. Cl.
CPC .... *F05D 2240/81* (2013.01); *F05D 2260/202* (2013.01); *F23R 2900/03041* (2013.01); *F23R 2900/03042* (2013.01); *F23R 2900/03044* (2013.01)

(56) References Cited

U.S. PATENT DOCUMENTS

| | | | | |
|---|---|---|---|---|
| 8,777,570 | B1 | 7/2014 | Liang | |
| 9,410,702 | B2 * | 8/2016 | Dudebout | F23R 3/16 |
| 2013/0205792 | A1 | 8/2013 | Gleiner et al. | |

FOREIGN PATENT DOCUMENTS

| | | | |
|---|---|---|---|
| EP | 2527597 | A2 | 11/2012 |
| EP | 2759772 | A1 | 7/2014 |
| WO | 2013/120999 | A1 | 8/2013 |

OTHER PUBLICATIONS

Mar. 10, 2015 Search Report in Great Britain Patent Application No. 1417587.1.

* cited by examiner

COOLED COMPONENT

FIELD OF THE INVENTION

The present invention relates to a cooled component and in particular to a cooled component of gas turbine engine.

BACKGROUND TO THE INVENTION

Components, for example turbine blades, turbine vanes, combustion chamber walls, of gas turbine engines and other turbomachines are cooled to maintain the component at a temperature where the material properties of the component are not adversely affected and the working life and the integrity of the component is maintained.

One method of cooling components, turbine blades, turbine vanes combustion chamber walls, of gas turbine engines provides a film of coolant on an outer surface of a wall of the component. The film of coolant is provided on the outer surface of the wall of the component by a plurality of effusion cooling apertures which are either arranged perpendicular to the outer surface of the wall or at an angle to the outer surface of the wall. The effusion apertures are generally manufactured by laser drilling, but other processes may be used, e.g. electro-chemical machining, electro-discharge machining or by casting. Effusion cooling apertures are often cylindrical and angled in the direction of flow of hot fluid over the outer surface of the component. Angled effusion cooling apertures have an increased internal surface area, compared to effusion cooling apertures arranged perpendicular to the outer surface of the wall of the component, and the increased internal surface area increases the heat transfer from the wall of the component to the coolant. Angled effusion apertures provide a film of coolant on the outer surface of the component which has improved quality compared to effusion cooling apertures arranged perpendicular to the outer surface of the wall of the component.

However, despite the use of cylindrical effusion cooling apertures angled in the direction of flow of hot fluid over the surface of the component, the coolant passing through the cylindrical effusion cooling apertures often retains a significant component of velocity in direction perpendicular to the surface of the component. This causes the jets of coolant exiting the cylindrical effusion cooling apertures to detach from the surface of the component and results in a poor film of coolant on the surface of the component. The high velocity of the jets of coolant also increases the mixing between the coolant and the hot fluid flowing over, or a hot fluid adjacent to, the surface of the component and this raises the temperature of the film of coolant and therefore reduces its cooling effect. Additionally there may be relatively large distances between adjacent effusion cooling apertures and this may result in a film of coolant which is non-uniform across the surface of the component and hence there may be hot spots on the surface of the component between effusion cooling apertures.

The use of a larger number of smaller diameter effusion cooling apertures, compared to a smaller number of larger diameter effusion cooling apertures, may be used to increase the internal surface area of the angled effusion apertures for the same total mass flow of coolant. However, it is expensive and time consuming to drill a large number of effusion cooling apertures using conventional manufacturing techniques, e.g. laser drilling, electro-chemical machining or electro-discharge machining.

The use of fanned effusion cooling apertures provides enhanced film cooling effectiveness, but fanned effusion cooling apertures have un-aerodynamic diffusion which suffers from flow separation and reduces its cooling effect.

Therefore the present invention seeks to provide a novel cooled component which reduces or overcomes the above mentioned problem.

SUMMARY OF THE INVENTION

Accordingly the present invention provides a cooled component comprising a wall having a first surface and a second surface, the wall having a plurality of effusion cooling apertures extending there-through from the first surface to the second surface, each aperture having an inlet in the first surface and an outlet in the second surface, each effusion cooling aperture having a metering portion and a diffusing portion arranged in flow series from the inlet to the outlet, each metering portion being elongate and having a width and length, the width of each metering portion being greater than the length of the metering portion, the metering portion of each effusion cooling aperture having a U-shaped bend, the diffusing portion of each effusion cooling aperture being arranged at an angle to the second surface, each outlet having a quadrilateral shape in the plane of the second surface of the wall.

Each inlet may have an elongate shape in the first surface of the wall and the inlet in the first surface of the wall being arranged to extend substantially laterally.

Alternatively each inlet may have an elongate shape in the first surface of the wall and the inlet in the first surface of the wall being arranged substantially diagonally with respect to the outlet in the second surface of the wall.

Each U-shaped bend may have a curved upstream end wall and a curved downstream end wall, the curved upstream end wall is convex and the curved downstream end wall is concave.

Each outlet may have a rectangular shape, a parallelogram shape, a rhombus shape or an isosceles trapezium shape.

Each outlet may have a rectangular shape, each outlet is arranged such that two of the sides of the rectangular shape extend laterally and two of the sides of the rectangular shape extend longitudinally.

Each outlet may have a rhombus shape or an isosceles trapezium shape, each outlet is arranged such that two of the sides of the shape extend laterally and two of the sides of the rectangular shape extend longitudinally and laterally.

Each inlet may have a curved upstream end wall, a curved downstream end wall and curved side walls, the curved upstream end wall is concave, the curved downstream end wall is convex and the curved side walls are concave.

The curved upstream and downstream end walls may diverge in the longitudinal, axial, direction of the wall.

The effusion cooling apertures being arranged in longitudinally spaced rows and the apertures in each row being laterally spaced apart.

The effusion cooling apertures in each row are offset laterally from the effusion cooling apertures in each adjacent row.

The ratio of the width of the metering portion to the length of the metering portion may be from 3 to 1 to 8 to 1. The width of the metering portion may be from 0.9 mm to 2.4 mm and the length of the metering portion may be 0.3 mm.

The metering portion may be arranged at an angle of between 10° and 20° to the second surface.

The first surface may be corrugated and the corrugations are longitudinally spaced.

The corrugations may be axially spaced.

The U-shaped bend of the metering portion of each effusion cooling aperture may be aligned longitudinally with a corresponding one of the corrugations in the first surface of the wall.

The U-shaped bend of the metering portion of each effusion cooling aperture may be aligned axially with a corresponding one of the corrugations in the first surface of the wall.

The first surface may have a plurality of rows bulges, the bulges in each row are laterally spaced and the rows of bulges are longitudinally spaced.

The rows of bulges may be axially spaced.

The U-shaped bend of the metering portion of each effusion cooling aperture may be aligned laterally and longitudinally with a corresponding one of the bulges in the first surface of the wall.

The U-shaped bend of the metering portion of each effusion cooling aperture may be aligned circumferentially and axially with a corresponding one of the bulges in the first surface of the wall.

The metering portion of the effusion cooling apertures may have a length of 0.3 mm and a width of 0.9 mm, the metering portion of the effusion cooling apertures is arranged at an angle of between 12° to the second surface, a surface of the diffusing portion of the effusion cooling apertures is arranged at an angle of 12° to the second surface to form the diffusing portion.

The metering portion of the effusion cooling apertures may have a length of 0.3 mm and a width of 0.9 mm, the metering portion of the effusion cooling apertures is arranged at an angle of 17° to the second surface, a surface of the diffusing portion of the effusion cooling apertures is arranged at an angle of 17° to the second surface to form the diffusing portion.

The effusion cooling apertures in each row may be spaced apart by 1 mm in the second surface and the effusion cooling apertures in adjacent rows may be spaced apart by 7 mm in the second surface.

The cooled component may comprise a second wall, the second wall having a third surface and a fourth surface, the fourth surface of the second wall being spaced from the first surface of the wall and the second wall having a plurality of impingement cooling apertures extending there-through from the third surface to the fourth surface.

The metering portion of the effusion cooling apertures may have a length of 0.3 mm and a width of 2.4 mm, the metering portion of the effusion cooling apertures is arranged at an angle of 16° to the second surface, a surface of the diffusing portion of the effusion cooling aperture is arranged at an angle of 16° to the second surface to form the diffusing portion.

The effusion cooling apertures in each row may be spaced apart by 3.4 mm in the second surface and the effusion cooling apertures in adjacent rows may be spaced apart by 4.7 mm in the second surface.

At least some of the impingement cooling apertures in the second wall are aligned with the corrugations in the first surface of the wall.

At least some of the impingement cooling apertures in the second wall are aligned with the bulges in the first surface of the wall.

The rectangular shape may be square.

The cooled component may be a turbine blade, a turbine vane, a combustion chamber wall, a combustion chamber tile, a combustion chamber heat shield, a combustion chamber wall segment or a turbine shroud.

The cooled combustion chamber wall may be an annular combustion chamber wall and the annular combustion chamber wall has each outlet arranged such that the two of the sides of the rectangular shape which extend laterally extend circumferentially of the combustion chamber wall and the two of the sides of the rectangular shape which extend longitudinally extend axially of the combustion chamber wall. The effusion cooling apertures being arranged in axially spaced rows and the apertures in each row being circumferentially spaced apart. The effusion cooling apertures in each row are offset circumferentially from the effusion cooling apertures in each adjacent row.

The cooled combustion chamber tile may be a combustion chamber tile for an annular combustion chamber wall and the combustion chamber tile has each outlet arranged such that the two of the sides of the rectangular shape which extend laterally extend circumferentially of the combustion chamber tile and the two of the sides of the rectangular shape which extend longitudinally extend axially of the combustion chamber tile. The effusion cooling apertures being arranged in axially spaced rows and the apertures in each row being circumferentially spaced apart. The effusion cooling apertures in each row are offset circumferentially from the effusion cooling apertures in each adjacent row.

The cooled combustion chamber wall segment may be a combustion chamber wall segment for an annular combustion chamber wall and the combustion chamber wall segment comprises an outer wall and an inner wall spaced from the outer wall, the outer wall has a plurality of impingement cooling apertures and the inner wall has a plurality of effusion cooling apertures, the inner wall has each outlet arranged such that the two of the sides of the rectangular shape which extend laterally extend circumferentially of the combustion chamber segment and the two of the sides of the rectangular shape which extend longitudinally extend axially of the combustion chamber segment. The effusion cooling apertures being arranged in axially spaced rows and the apertures in each row being circumferentially spaced apart. The effusion cooling apertures in each row are offset circumferentially from the effusion cooling apertures in each adjacent row.

The cooled turbine blade, or turbine vane, may have each outlet arranged such that the two of the sides of the rectangular shape which extend laterally extend radially of the turbine blade, or turbine vane, and the two of the sides of the rectangular shape which extend longitudinally extend axially of the turbine blade or turbine vane. The effusion cooling apertures may be arranged in axially spaced rows and the apertures in each row being radially spaced apart. The effusion cooling apertures in each row may be offset radially from the effusion cooling apertures in each adjacent row.

The cooled component may comprise a superalloy, for example a nickel, or cobalt, superalloy.

The cooled component may be manufactured by additive layer manufacturing, for example direct laser deposition.

The cooled component may be a gas turbine engine component or other turbomachine component, e.g. a steam turbine, or an internal combustion engine etc.

The gas turbine engine may be an aero gas turbine engine, an industrial gas turbine engine, a marine gas turbine engine or an automotive gas turbine engine. The aero gas turbine engine may be a turbofan gas turbine engine, a turbo-shaft gas turbine engine, a turbo-propeller gas turbine engine or a turbojet gas turbine engine.

BRIEF DESCRIPTION OF THE DRAWINGS

The present disclosure will be more fully described by way of example with reference to the accompanying drawings, in which:—

DETAILED DESCRIPTION

Figure 1:
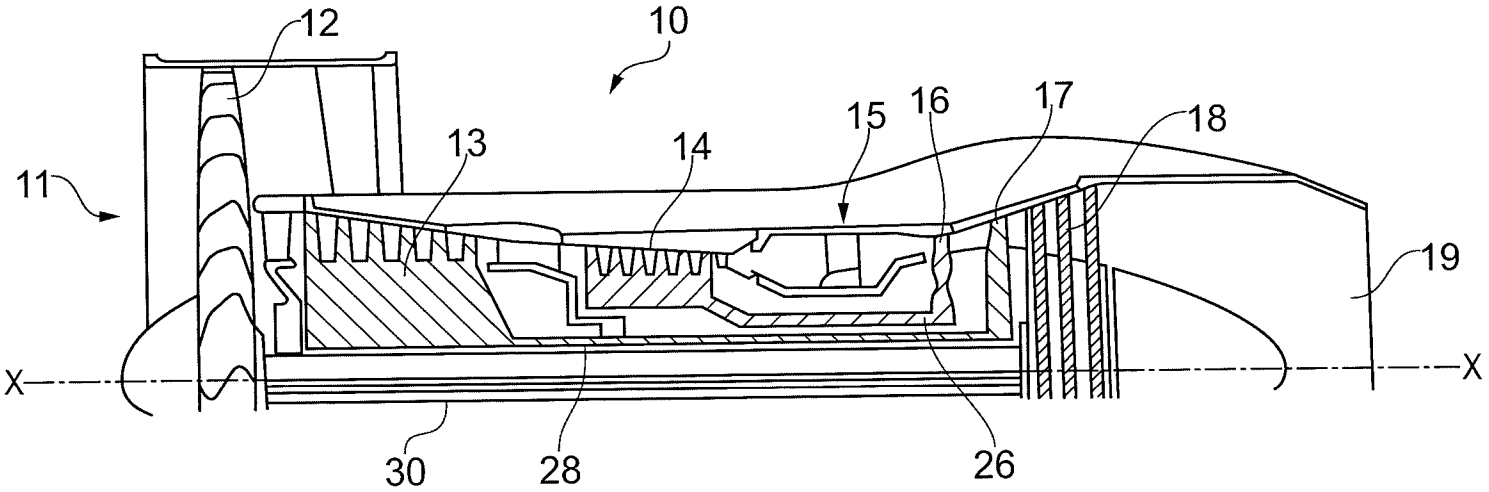
FIG. 1 is partially cut away view of a turbofan gas turbine engine having a cooled combustion chamber wall according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
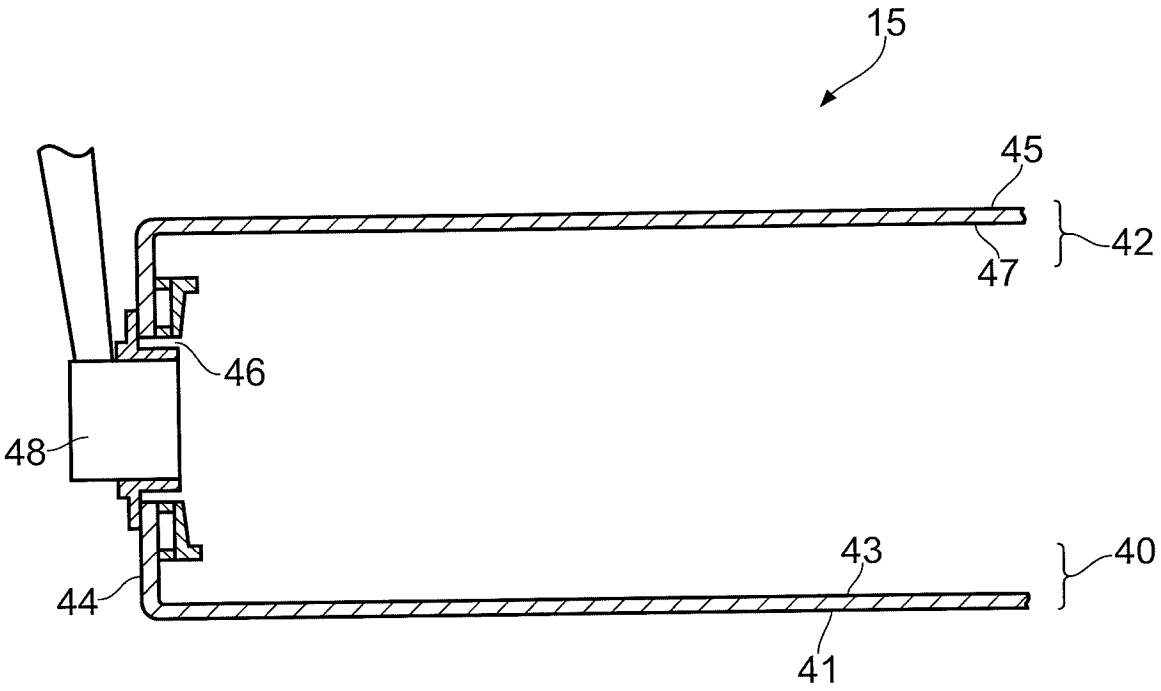
FIG. 2 is an enlarged cross-sectional view of a cooled combustion chamber wall according to the present disclosure.

The combustion chamber 15, as shown more clearly in FIG. 2, is an annular combustion chamber and comprises a radially inner annular wall 40, a radially outer annular wall structure 42 and an upstream end wall 44. The upstream end of the radially inner annular wall 40 is secured to the upstream end wall structure 44 and the upstream end of the radially outer annular wall 42 is secured to the upstream end wall 44. The upstream end wall 44 has a plurality of circumferentially spaced apertures 46 and each aperture 46 has a respective one of a plurality of fuel injectors 48 located therein. The fuel injectors 48 are arranged to supply fuel into the annular combustion chamber 15 during operation of the gas turbine engine 10 and as mentioned above the fuel is burnt in air supplied into the combustion chamber 15.

The radially inner annular wall 40 and the radially outer annular wall 42 are cooled components of the turbofan gas turbine engine 10. The radially inner annular wall 40 has a first surface 41 and a second surface 43 and similarly the radially outer annular wall 42 has a first surface 45 and a second surface 47.

Figure 3:
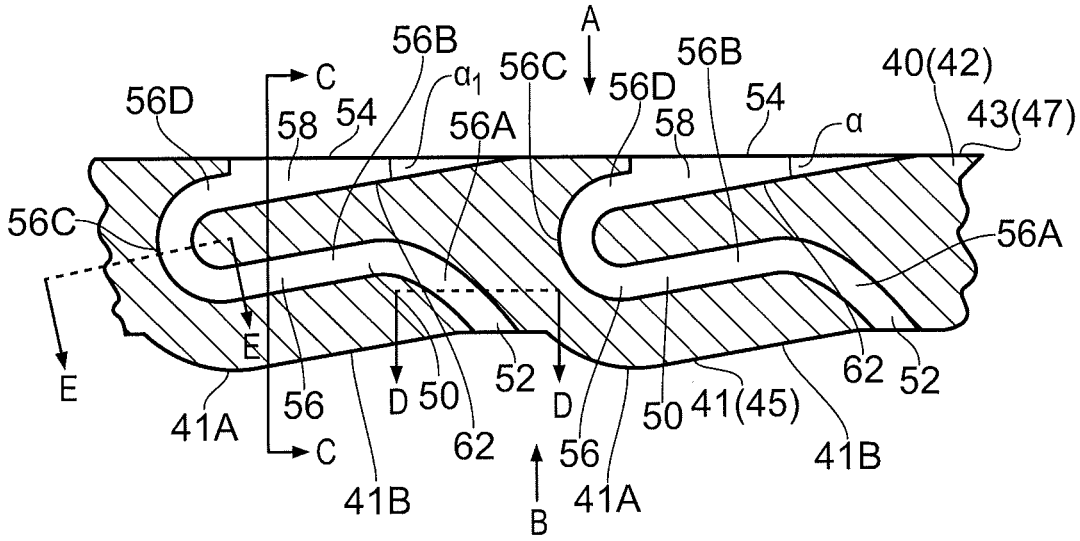
FIG. 3 is an enlarged cross-sectional view through the cooled combustion chamber wall shown in FIG. 2.
Figure 4:
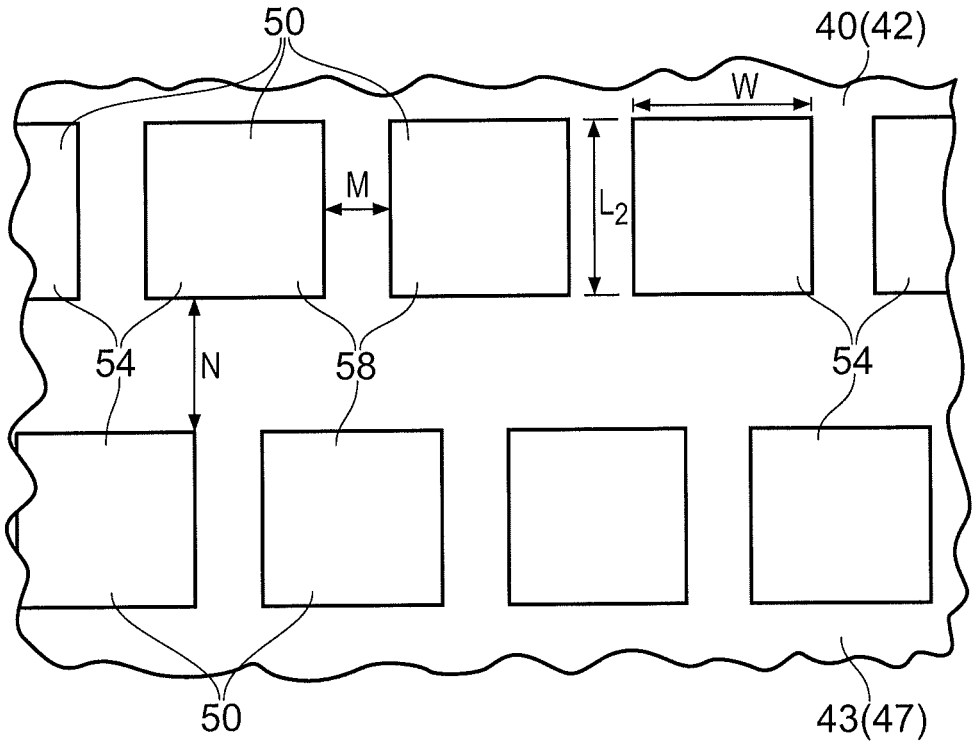
FIG. 4 is a view of the cooled combustion chamber wall in the direction of arrow A in FIG. 3.
Figure 5:
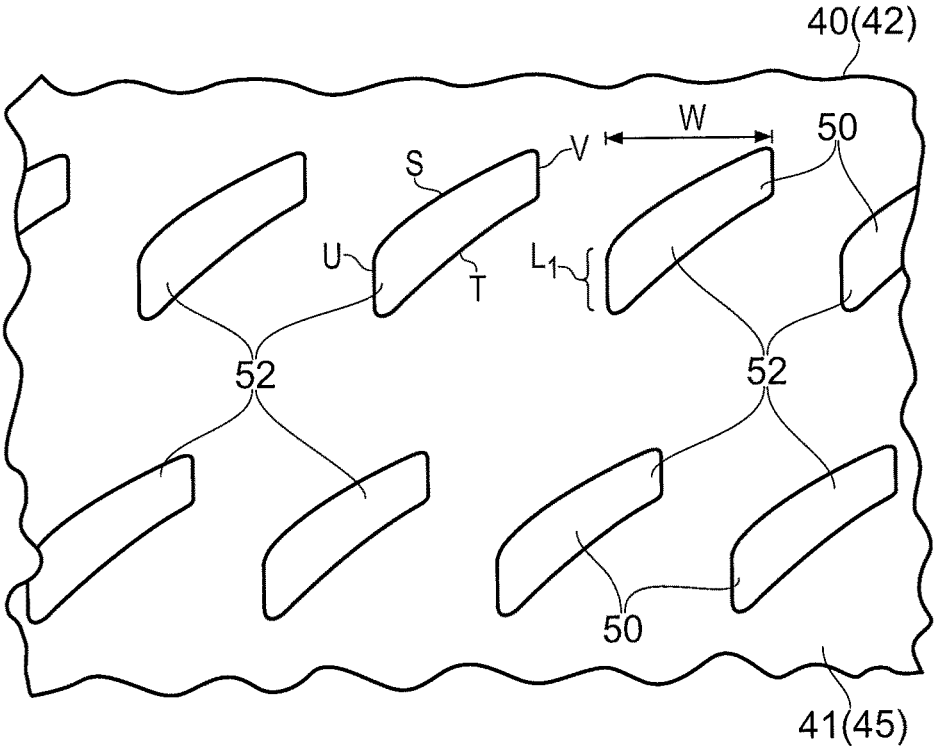
FIG. 5 is a view of the cooled combustion chamber wall in the direction of arrow B in FIG. 3.
Figure 6:
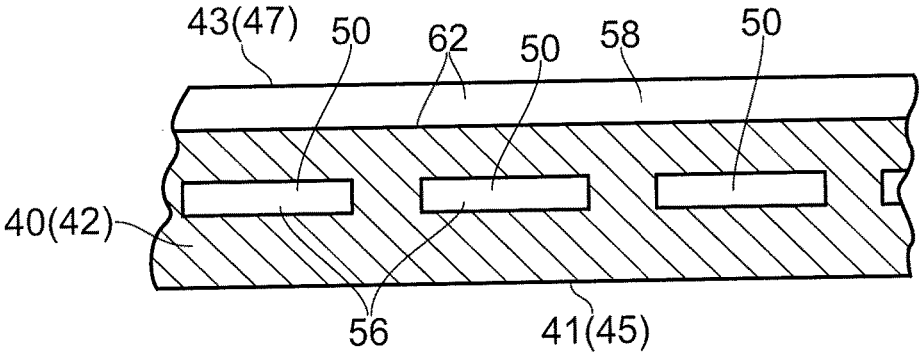
FIG. 6 is a cross-sectional view in the direction of arrows C-C in FIG. 3.
Figure 7:
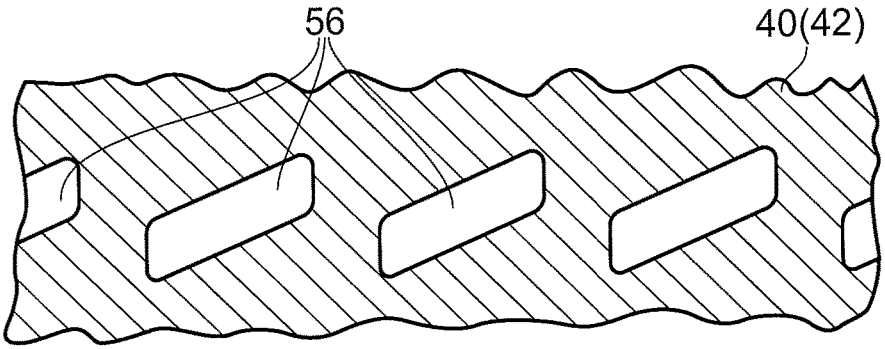
FIG. 7 is a cross-sectional view in the direction of arrows D-D in FIG. 3.

The radially inner annular wall 40 has a plurality of effusion cooling apertures 50 extending there-through from the first surface 41 to the second surface 43, as shown more clearly in FIGS. 3 to 9. Each aperture 50 has an inlet 52 in the first surface 41 and an outlet 54 in the second surface 43, as shown in FIG. 3. Each effusion cooling aperture 50 has a metering portion 56 and a diffusing portion 58 arranged in flow series from the inlet 52 to the outlet 54. Each metering portion 56 is elongate and has a width W and length $L_1$ and the width W of each metering portion 56 is greater than the length $L_1$ of the metering portion 56, as shown in FIG. 5. Each diffusing portion 58 increases in dimension in length from the length $L_1$ at the metering portion 56 to a length $L_2$ at the outlet 54 and each outlet 54 has a rectangular shape in the plane of the second surface 43 of the radially inner annular wall 40, as shown in FIG. 4. Each inlet 52 has an elongate shape in the plane of the first surface 41 of the radially inner annular wall 40 and the inlet 52 in the first surface 41 of the radially inner annular wall 40 is arranged substantially diagonally with respect to the outlet 54 in the second surface 43 of the radially inner annular wall 40. Each inlet 52 has a curved upstream end S, a curved downstream end T and curved sides U and V, the curved upstream end S is concave, the curved downstream end T is convex and the curved sides U and V are concave. The curved upstream and downstream ends S and T diverge in the longitudinal, axial, direction of the radially inner annular wall 40, as shown in FIG. 5. Each outlet 54 is arranged such that two of the sides of the rectangular shape extend laterally and two of the sides of the rectangular shape extend longitudinally and in particular two of the sides of the rectangular shape which extend laterally extend circumferentially of the radially inner annular wall 40 and the two of the sides of the rectangular shape which extend longitudinally extend axially of the radially inner annular wall 40. The effusion cooling apertures 50 are arranged in longitudinally spaced rows and the apertures 50 in each row are laterally spaced apart and in particular the effusion cooling apertures 50 are arranged in axially spaced rows and the apertures 50 in each row are circumferentially spaced apart. The effusion cooling apertures 50 in each row are offset laterally from the effusion cooling apertures 50 in each adjacent row and in particular the effusion cooling apertures 50 in each row are offset circumferentially from the effusion cooling apertures 50 in each adjacent row.

Figure 8:
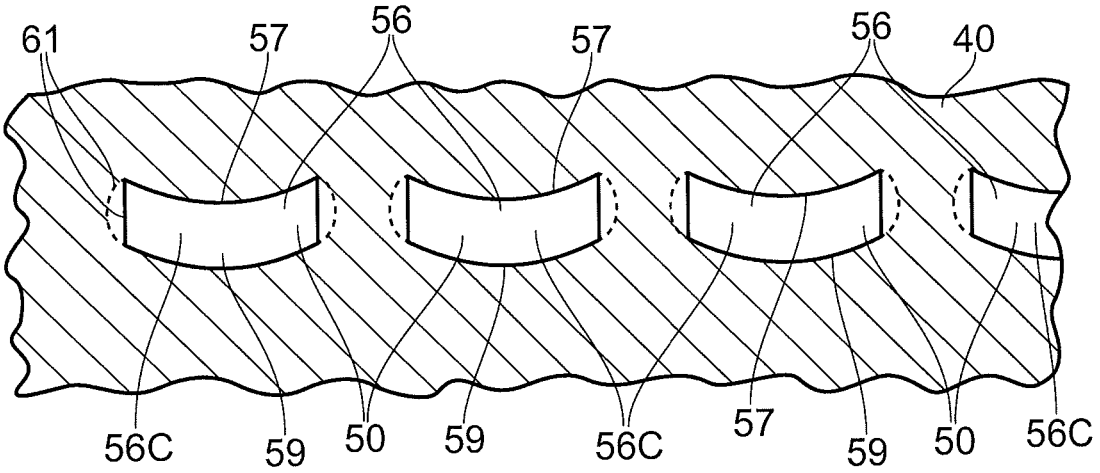
FIG. 8 is a cross-sectional view in the direction of arrows E-E in FIG. 3.

The metering portion 56 of each effusion cooling aperture 50 comprises an inlet portion 56A, a longitudinally upstream extending portion 56B, a U-shaped bend portion 56C and a longitudinally downstream extending portion 56D, as shown in FIGS. 3 and 8. The longitudinally downstream extending portion 56D is connected to the diffusing portion 58 of the effusion cooling aperture 50. The longitudinally upstream extending portion 56B and the longitudinally downstream extending portion 56D are substantially parallel. The longitudinally upstream extending portion 56B and the longitudinally downstream extending portion 56D of the metering portion 56 and a surface 62 of the diffusing portion 58 are substantially parallel.

It is to be noted that the inlet 52 of each effusion cooling aperture 50 is arranged substantially diagonally, extending with lateral, circumferential, and longitudinal, axial, components and the outlet 54 of each effusion cooling aperture 52 is rectangular in shape. The metering portion 56 of each effusion cooling aperture 50 gradually changes the effusion cooling aperture 50 from the diagonal alignment at the inlet 52 to a rectangular shape at the junction between the inlet portion 56A and the longitudinally upstream extending portion 56B, as shown in FIGS. 5 to 9. The gradual changes in the effusion cooling aperture 50 between the diagonal alignment to the rectangular shape at the junction between the inlet portion 56A and the longitudinally upstream extending portion 56B and the diffusing portion 58 are preferably designed to be aerodynamic. The outlet 54 of the effusion cooling aperture 50 is designed to aerodynamically blend from the diffusing portion 58 to the second surface 43.

The first surface 41 of the radially inner annular wall 40 is provided with a plurality of rows of bulges 41A, the bulges 41A in each row are laterally, circumferentially, spaced and the rows of bulges 41A are longitudinally, axially, spaced on the radially inner annular wall 40. The bulges 41A are localised regions where the first surface 41 of the radially inner annular wall 40 is curved to a maximum distance from the second surface 43 of the radially inner annular wall 40. The U-shaped bend portion 58C of the metering portion 58 of each effusion cooling aperture 50 is aligned laterally, circumferentially, and longitudinally, axially, with a corresponding one of the bulges 41A in the first surface 41. In particular the junction between the longitudinally upstream extending portion 56B and the U-shaped bend portion 56C of each effusion cooling aperture 50 is aligned longitudinally, axially, with the point of an associated bulge 41A which is at a maximum distance from the second surface 43 of the radially inner annular wall 40. The U-bend shaped portion 56C of each effusion cooling aperture 50 is the most upstream portion of the effusion cooling aperture 50. The longitudinally upstream extending portion 56B of each effusion cooling aperture 50 is arranged substantially parallel with a portion 41B of the first surface 41 of the radially inner annular wall 40 between the bulge 41A aligned with the junction between the longitudinally upstream extending portion 56B and the U-shaped bend portion 56C of that effusion cooling aperture 50 and the inlet 52 of that effusion cooling aperture 50.

Alternatively, the first surface 41 of the radially inner annular wall 40 is corrugated and the corrugations 41A are longitudinally, axially, spaced and the corrugations 41A extend laterally, circumferentially, of the radially inner annular wall 40. The corrugations 41A are regions where the first surface 41 of the radially inner annular wall 40 is curved to a maximum distance from the second surface 43 of the radially inner annular wall 40. The U-shaped bend portion 58C of the metering portion 58 of each effusion cooling aperture 50 is aligned longitudinally, axially, with a corresponding one of the corrugations 41A in the first surface 41. In particular the junction between the longitudinally upstream extending portion 56B and the U-shaped bend portion 56C of each effusion cooling aperture 50 is aligned longitudinally, axially, with the point of an associated corrugation 41A which is at a maximum distance from the second surface 43 of the radially inner annular wall 40. The U-bend shaped portion 56C of each effusion cooling aperture 50 is the most upstream portion of the effusion cooling aperture 50. The longitudinally upstream extending portion 56B of each effusion cooling aperture 50 is arranged substantially parallel with a portion 41B of the first surface 41 of the radially inner annular wall 40 between the corrugation 41A aligned with the junction between the longitudinally upstream extending portion 56B and the U-shaped bend portion 56C of that effusion cooling aperture 50 and the inlet 52 of that effusion cooling aperture 50.

The U-shaped bend portion 56C of each effusion cooling aperture 50 has a curved upstream end wall 57 and the curved upstream surface 57 is convex so as to enable the effusion cooling aperture 50 to be manufactured by additive layer manufacturing. The U-shaped bend portion 56C of each effusion cooling aperture 50 also has a curved downstream end wall 59 and the curved downstream surface 59 is concave so as to enable the effusion cooling aperture 50 to be manufactured by additive layer manufacturing, as shown in FIG. 8. The laterally spaced end walls 61 of each U-shaped bend portion 56C of each effusion cooling aperture 50 may be planar, as shown, or may be curved, e.g. concave as shown in dashed lines. The laterally spaced end walls of the metering portion 56 of each effusion cooling aperture 50 may be planar or may be curved, e.g. concave.

It is to be noted that the inlet 52 of each effusion cooling aperture 50 is axially downstream of the U-shaped bend portion 56C of the metering portion 56 of the effusion cooling aperture 50 and the outlet 54 of each effusion cooling aperture 50 is axially downstream of the U-shaped bend portion 56C of the metering portion 56 of the effusion cooling aperture 50.

Figure 9:
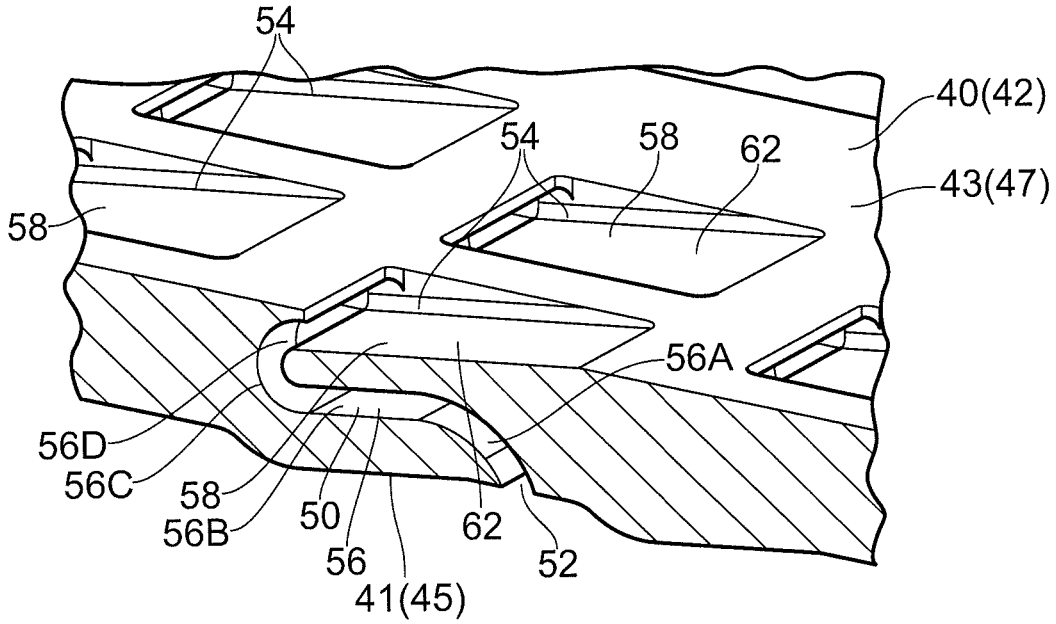
FIG. 9 is a part cut-away perspective view of the cooled combustion chamber wall in FIG. 2.

The surface 62 of the diffusing portion 58 blends smoothly into the side surfaces of the recess as shown in FIG. 9.

The ratio of the width W of the metering portion 56 to the length $L_1$ of the metering portion 56 may be from 3 to 1 to 8 to 1. The width W of the metering portion 56 may be from 0.9 mm to 2.4 mm and the length $L_1$ of the metering portion 56 may be 0.3 mm.

The metering portion 56 of each effusion cooling aperture 50 may be arranged at an angle $\alpha_1$ of between 10° and 20° to the first surface 41.

In one arrangement the metering portion 56 of the effusion cooling apertures 50 have a length of 0.3 mm and a width of 0.9 mm, the metering portion 56 of the effusion cooling apertures 50 is arranged at an angle of 12° to the second surface 43, a surface 62 of the diffusing portion 58 of the effusion cooling apertures 50 is arranged at an angle $\alpha_1$ of 12° to the second surface 43. The surface 62 of the diffusing portion 58 of the effusion cooling aperture 50 forms the bottom surface of a recess in the second surface 43 of the wall 40.

In another arrangement the metering portion 56 of the effusion cooling apertures 50 have a length of 0.3 mm and a width of 0.9 mm, the metering portion 56 of the effusion cooling apertures 50 is arranged at an angle $\alpha_1$ of 17° to the second surface 43, a surface 62 of the diffusing portion 58 of the effusion cooling apertures 50 is arranged at an angle $\alpha_1$ of 17° to the second surface 43. The surface 62 of the diffusing portion 58 of the effusion cooling aperture 50 forms the bottom surface of a recess in the second surface 43 of the wall 40.

The effusion cooling apertures 50 in each row may be spaced apart by a distance M of 1 mm in the second surface 43 and the effusion cooling apertures 50 in adjacent rows may be spaced apart by a distance N of 7 mm in the second surface 53.

The radially outer annular wall 42 has a plurality of effusion cooling apertures 50 extending there-through from the first surface 41 to the second surface 43, as shown more clearly in FIGS. 3 to 8 and these effusion cooling apertures 50 are arranged substantially the same as the effusion cooling apertures 50 in the radially inner annular wall 40.

In operation coolant, for example air supplied from the high pressure compressor 14 of the gas turbine engine 10, flowing over the radially inner and outer annular walls 40 and 42 respectively is supplied through the effusion cooling apertures 50 from the first surface 41 or 45 to the second surface 43 or 47 of the radially inner and outer annular walls 40 and 42 respectively. The flow of coolant through the effusion cooling apertures 50 exits the effusion cooling apertures 50 and then flows over the second surfaces 43 or 47 of the radially inner and outer annular walls 40 and 42 respectively to form film of coolant on the second surfaces 43 or 47 of the radially inner and outer annular walls 40 and 42 respectively. The coolant flows through a serpentine flow path through each of the effusion cooling apertures 50 and in particular the coolant flows in a longitudinal upstream direction through the inlet portion 56A and the longitudinally upstream extending portion 56B and then reverses direction in the U-shaped bend portion 56C to flow in a longitudinally downstream direction through the longitudinally downstream extending portion 56D and diffusing portion 58.

Figure 10:
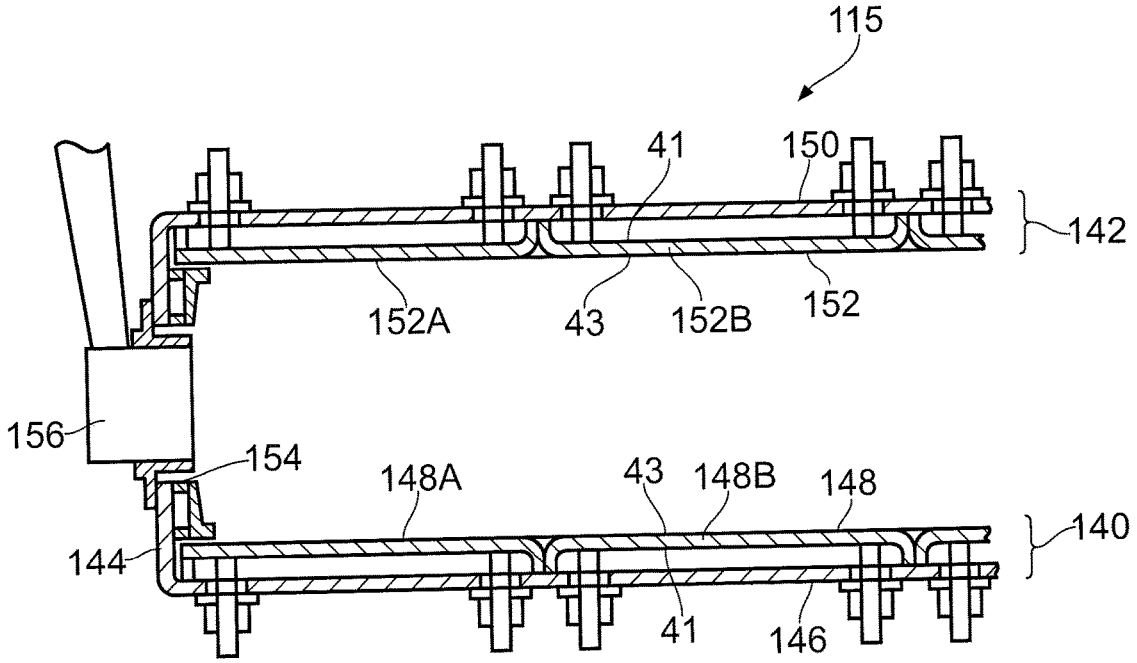
FIG. 10 is an enlarged cross-sectional view of an alternative cooled combustion chamber wall according to the present disclosure.

Another combustion chamber 115, as shown more clearly in FIG. 10, is an annular combustion chamber and comprises a radially inner annular wall structure 140, a radially outer annular wall structure 142 and an upstream end wall structure 144. The radially inner annular wall structure 140 comprises a first annular wall 146 and a second annular wall 148. The radially outer annular wall structure 142 comprises a third annular wall 150 and a fourth annular wall 152. The second annular wall 148 is spaced radially from and is arranged radially around the first annular wall 146 and the first annular wall 146 supports the second annular wall 148. The fourth annular wall 152 is spaced radially from and is arranged radially within the third annular wall 150 and the third annular wall 150 supports the fourth annular wall 152. The upstream end of the first annular wall 146 is secured to the upstream end wall structure 144 and the upstream end of the third annular wall 150 is secured to the upstream end wall structure 144. The upstream end wall structure 144 has a plurality of circumferentially spaced apertures 154 and each aperture 154 has a respective one of a plurality of fuel injectors 156 located therein. The fuel injectors 156 are arranged to supply fuel into the annular combustion chamber 115 during operation of the gas turbine engine 10.

The second annular wall 148 comprises a plurality of rows of combustor tiles 148A and 148B and the fourth annular wall 152 comprises a plurality of rows of combustor tiles 152A and 152B. The combustor tiles 148A and 148B have threaded studs and nuts to secure the combustor tiles 148A and 148B onto the first annular wall 146 and the combustor tiles 152A and 152B have threaded studs and nuts to secure the combustor tiles 152A and 152B onto the third annular wall 150. Alternatively, the combustor tiles 148A and 148B may be secured to the first annular wall 146 by threaded bosses and bolts and the combustor tiles 152A and 152B may be secured to the third annular wall 150 by threaded bosses and bolts.

The combustor tiles 148A, 148B, 152A and 152B are cooled components of the turbofan gas turbine engine 10. Each of the combustor tiles 148A, 148B, 152A and 152B has a first surface 41 and a second surface 43. The combustion chamber tiles 148A, 148B, 152A and 152B are for annular combustion chamber wall 140 and 142 and each combustion chamber tile 148A, 148B, 152A and 152B has effusion cooling apertures 50, as shown in FIGS. 3 to 9. Each combustion chamber tile 148A, 148B, 152A and 152B has each outlet 54 arranged such that the two of the sides of the rectangular shape which extend laterally extend circumferentially of the combustion chamber tile 148A, 148B, 152A and 152B and the two of the sides of the rectangular shape which extend longitudinally extend axially of the combustion chamber tile 148A, 148B, 152A and 152B. The effusion cooling apertures 50 are arranged in axially spaced rows and the apertures 50 in each row are circumferentially spaced apart. The effusion cooling apertures 50 in each row are offset circumferentially from the effusion cooling apertures 50 in each adjacent row.

The first annular wall 146 and the third annular wall 150 are provided with a plurality of impingement cooling apertures extending there-through to direct coolant onto the first surfaces 41 of the combustor tiles 148A, 148B, 152A and 152B. At least some of the impingement cooling apertures in the first annular wall and the third annular wall are aligned with the bulges 41A, or corrugations 41A, in the first surface 41 of the second and fourth annular walls 148 and 152 respectively.

The combustor tiles 148A, 148B, 152A and 152B may have lands, e.g. pedestals, pins, fins, extending from the first surfaces 41 towards the first annular wall 146 and third annular wall 150 respectively. The impingement cooling apertures may be circular, elliptical or slotted, e.g. rectangular, in cross-section. The impingement cooling apertures may have a shaped, curved, inlet to form a bell-mouth inlet.

The metering portion 56 of the effusion cooling apertures 50 have a length of 0.3 mm and a width of 2.4 mm, the metering portion 56 of the effusion cooling apertures 50 is arranged at an angle $\alpha_1$ of 16° to the second surface 43. A surface 62 of the diffusing portion 56 of the effusion cooling aperture 50 is arranged at an angle $\alpha_1$ of 16° to the second surface 43. The surface 62 of the diffusing portion 58 of the effusion cooling aperture 50 forms the bottom surface of a recess in the second surface 43 of the wall 40.

The effusion cooling apertures 50 in each row are spaced apart by a distance M of 3.4 mm in the second surface 43 and the effusion cooling apertures 50 in adjacent rows may be spaced apart by a distance N of 4.7 mm in the second surface 43.

In operation coolant, for example air supplied from the high pressure compressor 14 of the gas turbine engine 10, flowing over the radially inner and outer annular wall structures 140 and 142 respectively is supplied through the impingement cooling apertures in the first and third annular walls 146 and 150 and onto the first surfaces 41 of the combustor tiles 148A, 148B, 152A and 152B of the second and fourth annular walls 148 and 152 to provide impingement cooling of the combustor tiles 148A, 148B, 152A and 152B. Some of the coolant is directed onto the bulges 41A, or corrugations 41A, on the first surfaces 41 of the combustor tiles 148A, 148B, 152A and 152B. The coolant then flows through the effusion cooling apertures 50 in the combustor tiles 148A, 148B, 152A and 152B of the second and fourth annular walls 148 and 152 from the first surface 41 to the second surface 43 of the combustor tiles 148A, 148B, 152A and 152B of the second and fourth annular walls 148 and 152 radially inner and outer annular wall structures 140 and 142 respectively. The flow of coolant through the effusion cooling apertures 50 exits the effusion cooling apertures 50 and then flows over the second surfaces 43 of the combustor tiles 148A, 148B, 152A and 152B of the second and fourth annular walls 148 and 152 of the radially inner and outer annular wall structures 140 and 142 respectively to form a film of coolant on the second surfaces 43 of the combustor tiles 148A, 148B, 152A and 152B of the second and fourth annular walls 148 and 152 of the radially inner and outer annular wall structures 140 and 142 respectively. The coolant flows through a serpentine flow path through each of the effusion cooling apertures 50 and in particular the coolant flows in a longitudinal upstream direction through the inlet portion 56A and the longitudinally upstream extending portion 56B and then reverses direction in the U-shaped bend portion 56C to flow in a longitudinally downstream direction through the longitudinally downstream extending portion 56D and diffusing portion 58.

Figure 11:
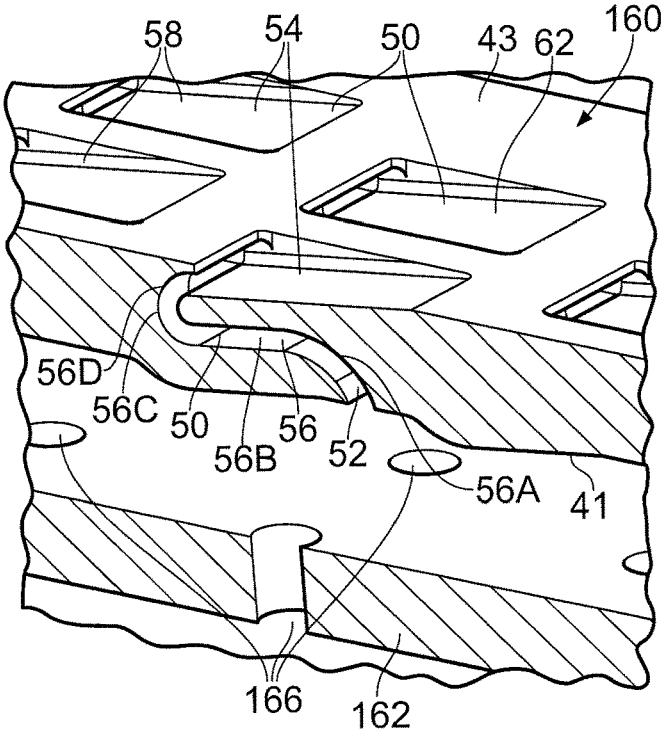
FIG. 11 is a part cut-away perspective view of a further cooled combustion chamber wall according to the present disclosure.

In another arrangement, not shown, an annular combustion chamber wall comprises a plurality of wall segments and each of the combustion chamber wall segments is a cooled component of the gas turbine engine. Each combustion chamber wall segment forms a predetermined angular portion of the annular combustion chamber wall and the combustion chamber wall segments are arranged circumferentially side by side to form the annular combustion chamber wall. Each combustion chamber wall segment 160, as shown in FIG. 11, comprises an outer wall 162 and an inner wall 164 spaced from the outer wall 162, the outer wall 162 has a plurality of impingement cooling apertures 166 and the inner wall 164 has a plurality of effusion cooling apertures 50 as shown in FIGS. 3 to 9. The inner wall 164 has each outlet 54 arranged such that the two of the sides of the rectangular shape which extend laterally extend circumferentially of the combustion chamber segment 160 and the two of the sides of the rectangular shape which extend longitudinally extend axially of the combustion chamber segment 160. The effusion cooling apertures 50 are arranged in axially spaced rows and the apertures 50 in each row are circumferentially spaced apart. The effusion cooling apertures 50 in each row are offset circumferentially from the effusion cooling apertures 50 in each adjacent row. The combustion chamber wall segments 160 may have lands, e.g. pedestals, pins, fins, extending from the inner wall 164 to the outer wall 162 and joining the inner wall 164 to the outer wall 162. The impingement cooling apertures 166 may be circular, elliptical or slotted, e.g. rectangular, in cross-section. The impingement cooling apertures 166 may have a shaped, curved, inlet to form a bell-mouth inlet.

Again the metering portion of the effusion cooling apertures have a length of 0.3 mm and a width of 2.4 mm, the metering portion of the effusion cooling apertures is arranged at an angle of 16° to the second surface, a surface of the diffusing portion of the effusion cooling aperture is arranged at an angle of 16° to the second surface. The surface 62 of the diffusing portion 58 of the effusion cooling aperture 50 forms the bottom surface of a recess in the second surface 43 of the wall 40.

The effusion cooling apertures in each row may be spaced apart by a distance M of 3.4 mm in the second surface and the effusion cooling apertures in adjacent rows may be spaced apart by a distance N of 4.7 mm in the second surface.

The constraint on the spacing between the effusion cooling apertures is a compound angle between the effusion cooling aperture geometries and hence the distances M and N are more generally at least 0.8 mm.

This operates in a similar manner to the arrangement in FIGS. 3 to 9 and FIG. 10.

Figure 12:
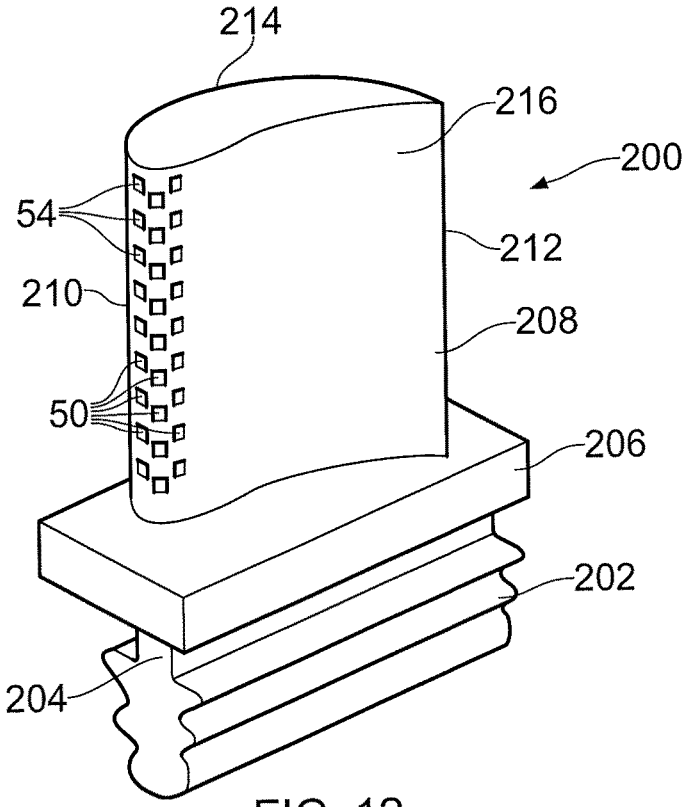
FIG. 12 is an enlarged perspective view of cooled turbine blade according to the present disclosure.

A turbine blade 200, as shown more clearly in FIG. 12, comprises a root portion 202, a shank portion 204, a platform portion 206 and an aerofoil portion 208. The aerofoil portion 208 has a leading edge 210, a trailing edge 212, convex wall 214 and a concave wall 216 and the convex and concave walls 214 and 216 extend from the leading edge 210 to the trailing edge 212. The turbine blade 200 is hollow and has a plurality of passages formed therein and is a cooled component of the gas turbine engine 10. The cooled turbine blade 200 has a plurality of effusion cooling apertures 50 extending through the convex and concave walls 214 and 216 respectively of the aerofoil portion 208 to cool the aerofoil portion 208 of the turbine blade 200. The effusion cooling apertures 50 are the same as those shown in FIGS. 3 to 9. Each outlet 54 is arranged such that the two of the sides of the rectangular shape which extend laterally extend radially of the turbine blade 200 and the two of the sides of the rectangular shape which extend longitudinally extend axially of the turbine blade 200. The effusion cooling apertures 50 are arranged in axially spaced rows and the apertures 50 in each row are radially spaced apart. The effusion cooling apertures 50 in each row are offset radially from the effusion cooling apertures 50 in each adjacent row. The bulges 41A in the first surface 41 are axially and radially spaced apart, or the corrugations 41A in the first surface 41 are axially spaced and extend radially, of the turbine blade 200.

It is to be noted that the inlet 52 of each effusion cooling aperture 50 is axially downstream of the U-shaped bend portion 56B of the metering portion 56 of the effusion cooling aperture 50 and the outlet 54 of each effusion cooling aperture 50 is axially downstream of the U-shaped bend portion 56B of the metering portion 56 of the effusion cooling aperture 50.

In operation coolant, for example air supplied from the high pressure compressor 14 of the gas turbine engine 10, is supplied into the passages within the turbine blade 200 and the coolant flows through the serpentine flow path through the effusion cooling apertures 50, as described previously, from the first surface 41 to the second surface 43 of the convex and concave walls 214 and 216 respectively of the aerofoil portion 208. The flow of coolant through the effusion cooling apertures 50 exits the effusion cooling apertures 50 and then flows over the second surfaces 43 of the convex and concave walls 214 and 216 respectively of the aerofoil portion 208 to form a film of coolant on the second surfaces 43 of the convex and concave walls 214 and 216 respectively of the aerofoil portion 208.

Figure 13:
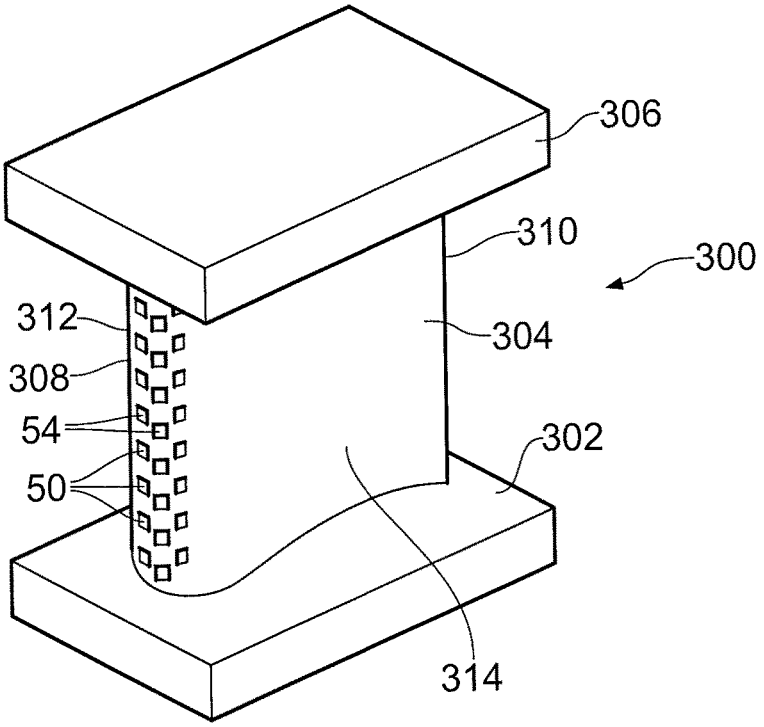
FIG. 13 is an enlarged perspective view of a cooled turbine vane according to the present disclosure.

A turbine vane 300, as shown more clearly in FIG. 13, comprises an inner platform portion 302, an aerofoil portion 304 and an outer platform portion 306. The aerofoil portion 304 has a leading edge 308, a trailing edge 310, convex wall 312 and a concave wall 314 and the convex and concave walls 312 and 314 extend from the leading edge 308 to the trailing edge 310. The turbine vane 300 is hollow and has a plurality of passages formed therein and is a cooled component of the gas turbine engine 10. The cooled turbine vane 300 has a plurality of effusion cooling apertures 50 extending through the convex and concave walls 312 and 314 respectively of the aerofoil portion 304 to cool the aerofoil portion 304 of the turbine vane 300. The effusion cooling apertures 50 are the same as those shown in FIGS. 3 to 9. Each outlet 54 is arranged such that the two of the sides of the rectangular shape which extend laterally extend radially of the turbine vane 300 and the two of the sides of the rectangular shape which extend longitudinally extend axially of the turbine vane 300. The effusion cooling apertures 50 are arranged in axially spaced rows and the apertures 50 in each row are radially spaced apart. The effusion cooling apertures 50 in each row are offset radially from the effusion cooling apertures 50 in each adjacent row. The bulges 41A in the first surface 41 are axially and radially spaced apart, or the corrugations 41A in the first surface 41 are axially spaced and extend radially, of the turbine vane 300.

It is to be noted that the inlet 52 of each effusion cooling aperture 50 is axially downstream of the U-shaped bend portion 56B of the metering portion 56 of the effusion cooling aperture 50 and the outlet 54 of each effusion cooling aperture 50 is axially downstream of the U-shaped bend portion 56B of the metering portion 56 of the effusion cooling aperture 50.

In operation coolant, for example air supplied from the high pressure compressor 14 of the gas turbine engine 10, is supplied into the passages within the turbine vane 300 and the coolant flows through the serpentine flow path through the effusion cooling apertures 50, as described previously, from the first surface 41 to the second surface 43 of the convex and concave walls 312 and 314 respectively of the aerofoil portion 304. The flow of coolant through the effusion cooling apertures 50 exits the effusion cooling apertures 50 and then flows over the second surfaces 43 of the convex and concave walls 312 and 314 respectively of the aerofoil portion 304 to form a film of coolant on the second surfaces 43 of the convex and concave walls 312 and 314 respectively of the aerofoil portion 304.

The turbine blade 200 may additionally have effusion cooling apertures in the platform portion 206 and/or the turbine vane 300 may additionally have effusion cooling apertures in the inner and/or outer platform portions 302 and 304 respectively.

The cooled component may comprise a second wall, the second wall being spaced from the first surface of the wall, the second wall having a third surface and a fourth surface, the fourth surface of the second wall being spaced from the first surface of the wall and the second wall having a plurality of impingement cooling apertures extending therethrough from the third surface to the fourth surface.

The metering portion of the effusion cooling apertures have a length of 0.3 mm and a width of 2.4 mm, the metering portion of the effusion cooling apertures is arranged at an angle of 16° to the second surface, a surface of the diffusing portion of the effusion cooling aperture is arranged at an angle of 16° to the second surface. The surface 62 of the diffusing portion 58 of the effusion cooling aperture 50 forms the bottom surface of a recess in the second surface 43 of the wall 40.

The effusion cooling apertures in each row may be spaced apart by a distance M of 3.4 mm in the second surface and the effusion cooling apertures in adjacent rows may be spaced apart by a distance N of 4.7 mm in the second surface.

Figure 14:
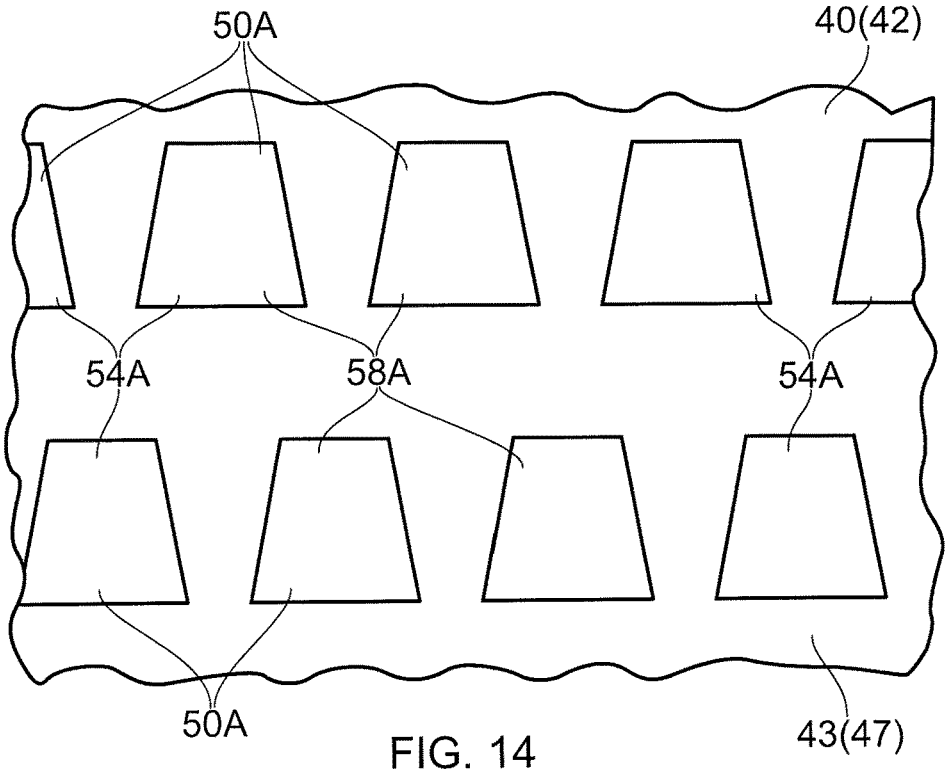
FIG. 14 is an alternative view of the cooled combustion chamber wall in the direction of arrow A in FIG. 3.

In an alternative arrangement of the present disclosure each outlet 54A has an isosceles trapezium shape in the plane of the second surface 43 of the radially inner annular wall 40, as shown in FIG. 14. Each outlet 54A is arranged such that two of the sides of the isosceles trapezium shape extend laterally and two of the sides of the isosceles trapezium shape extend longitudinally and laterally and in particular two of the sides of the isosceles trapezium shape which extend laterally extend circumferentially of the radially inner annular wall 40 and the two of the sides of the isosceles trapezium shape which extend longitudinally and laterally extend axially and circumferentially of the radially inner annular wall 40. The effusion cooling apertures 50A are arranged in longitudinally spaced rows and the apertures 50A in each row are laterally spaced apart and in particular the effusion cooling apertures 50A are arranged in axially spaced rows and the apertures 50A in each row are circumferentially spaced apart. The effusion cooling apertures 50A in each row are offset laterally from the effusion cooling apertures 50A in each adjacent row and in particular the effusion cooling apertures 50A in each row are offset circumferentially from the effusion cooling apertures 50A in each adjacent row. The downstream side of each effusion cooling aperture 50A is longer than the upstream side of the effusion cooling aperture 50A. This arrangement is also applicable to the turbine blade shown in FIG. 10 or the turbine vane shown in FIG. 11 but the lateral direction corresponds to a radial direction and the longitudinal direction corresponds to the axial direction.

Figure 15:
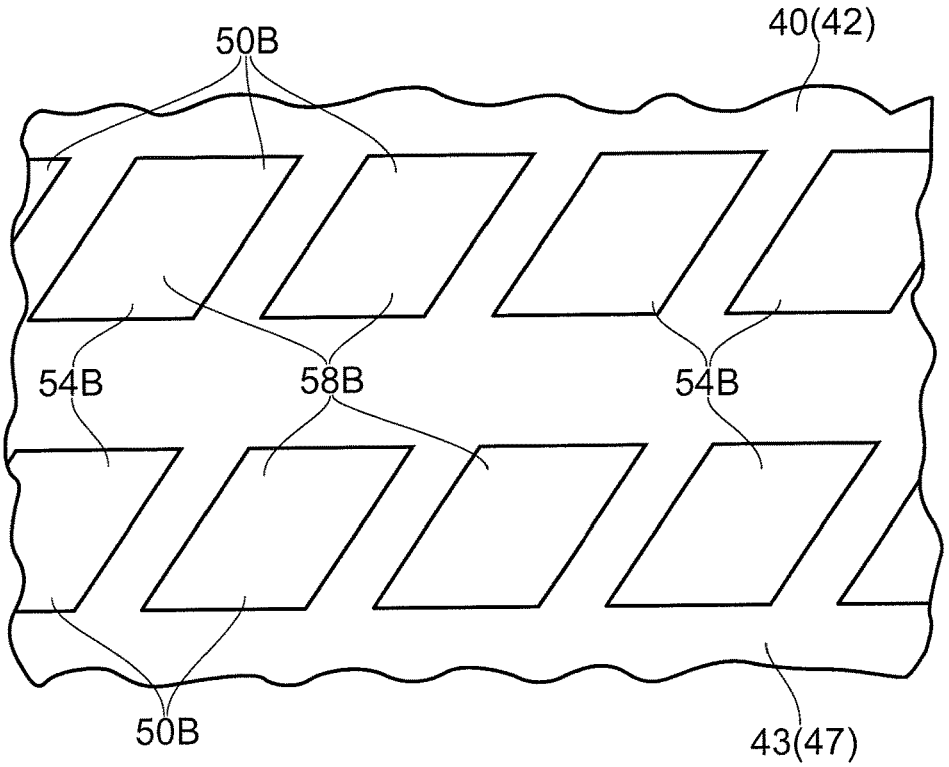
FIG. 15 is a further view of the cooled combustion chamber wall in the direction of arrow A in FIG. 3.

In an alternative arrangement of the present disclosure each outlet 54B has a rhombus shape in the plane of the second surface 43 of the radially inner annular wall 40, as shown in FIG. 15. Each outlet 54B is arranged such that two of the sides of the rhombus shape extend laterally and two of the sides of the rhombus shape extend longitudinally and laterally and in particular two of the sides of the rhombus shape which extend laterally extend circumferentially of the radially inner annular wall 40 and the two of the sides of the rhombus shape which extend longitudinally and laterally extend axially and circumferentially of the radially inner annular wall 40. The effusion cooling apertures 50B are arranged in longitudinally spaced rows and the apertures 50B in each row are laterally spaced apart and in particular the effusion cooling apertures 50B are arranged in axially spaced rows and the apertures 50B in each row are circumferentially spaced apart. The effusion cooling apertures 50B in each row are offset laterally from the effusion cooling apertures 50B in each adjacent row and in particular the effusion cooling apertures 50B in each row are offset circumferentially from the effusion cooling apertures 50B in each adjacent row. This arrangement is also applicable to the turbine blade shown in FIG. 11 or the turbine vane shown in FIG. 12 but the lateral direction corresponds to a radial direction and the longitudinal direction corresponds to the axial direction.

Figure 16:
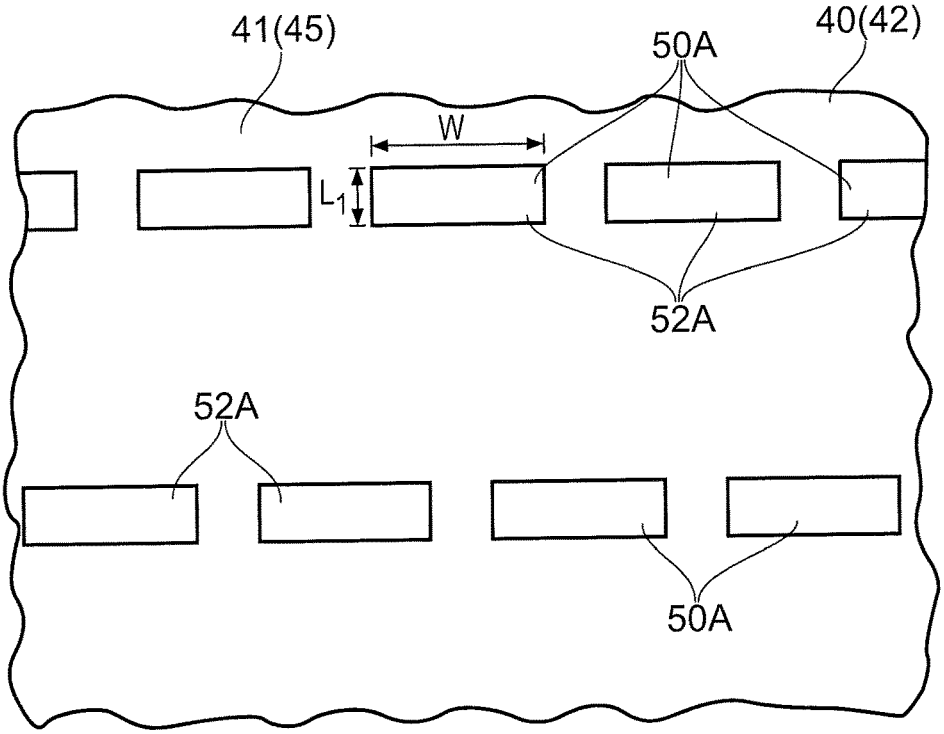
FIG. 16 is an alternative view of the cooled combustion chamber wall in the direction of arrow B in FIG. 3.

In an alternative arrangement of the present disclosure each inlet 52A has an elongate shape in the plane of the first surface 41 of the radially inner annular wall 40, as shown in FIG. 16. Each metering portion 56A is elongate and has a width W and length $L_1$ and the width W of each metering portion 56A is greater than the length $L_1$ of the metering portion 56, as shown in FIG. 16. Each diffusing portion 58 increases in dimension in length from the length $L_{1\ at}$ the metering portion 56A to a length $L_2$ at the outlet 54 and each outlet 54 has a rectangular shape in the plane of the second surface 43 of the radially inner annular wall 40, as shown in FIG. 4. Each inlet 52A has an elongate shape in the plane of the first surface 41 of the radially inner annular wall 40 and the inlet 52A in the first surface 41 of the radially inner annular wall 40 is arranged to extend substantially laterally with respect to the outlet 54 in the second surface 43 of the radially inner annular wall 40, e.g. circumferentially with respect to the combustion chamber. Each inlet 52A has a generally rectangular shape and the laterally spaced end walls of each inlet may be planar, as shown, or may be curved. It is to be noted that the effusion cooling apertures are inclined in the direction of flow of the hot gases over the cooled component. This arrangement is also applicable to the turbine blade shown in FIG. 11 or the turbine vane shown in FIG. 12 but the lateral direction corresponds to a radial direction and the longitudinal direction corresponds to the axial direction.

The cooled components, the cooled combustor chamber wall, the cooled combustion chamber combustor tile, the cooled combustion chamber heat shield, the cooled combustion chamber wall segment, the cooled turbine blade, the cooled turbine vane or cooled turbine shroud are preferably formed by additive layer manufacturing, for example direct laser deposition, selective laser sintering or direct electron beam deposition. The cooled component is built up layer by layer using additive layer manufacturing in the longitudinal, axial, direction of the wall which corresponds to the direction of flow of hot gases over the second surface of the wall.

The cooled combustion chamber walls in FIG. 2 may be manufactured by direct laser deposition in a powder bed by producing a spiral shaped wall sintering the powder metal layer by layer, (in the longitudinal, axial, direction of the wall) and then unravelling and welding, bonding, brazing or fastening the ends of what was the spiral shaped wall together to form an annular combustion chamber wall. The combustion chamber tiles of FIG. 10 may be manufactured by direct laser deposition in a powder bed by sintering the powder metal layer by layer in the longitudinal, axial, direction of the combustion chamber tile. The combustion chamber segments of FIG. 11 may be manufactured by direct laser deposition in a powder bed by sintering the powder metal layer by layer in the longitudinal, axial, direction of the combustion chamber tile.

Additive layer manufacturing enables the effusion cooling apertures to have diffusing portions which incline the resultant effusion flow of coolant closer to the surface of the wall of the cooled component and to diffuse the flow of coolant to reduce the exit velocity of the coolant. The effusion cooling apertures diffuse the flow of coolant in a direction perpendicular, normal, to the surface of the cooled component. The effusion cooling apertures have a high aspect ratio, ratio of width to length, and a low height in the metering portion of the effusion cooling apertures and this provides a high surface area to volume ratio which increases, maximises, the transfer of heat from the wall of the cooled component into the coolant flowing through the effusion cooling apertures. The outlets of the effusion cooling apertures in the surface of the cooled component are effectively recessed into the surface of the wall of the cooled component and each of these recesses is ensures that the coolant is more resistant to mixing with the hot gases and further enhances the overall cooling effectiveness. The inlets of the effusion cooling apertures are arranged diametrically and are curved so that the effusion cooling apertures may be manufactured by additive layer manufacturing processes. Another advantage of the effusion cooling apertures is that each one of the effusion cooling apertures occupies a smaller volume enabling more of them to be located in a particular region of the cooled component and hence this provides increased cooling of the component. The U-shaped bend in the metering portion of each effusion cooling aperture increases heat transfer to the coolant flowing through the effusion cooling aperture by increasing turbulence in the flow of the coolant in the U-shaped bend. The corrugations, or bulges, in the surface of the wall increase the heat transfer from the surface. Each effusion cooling aperture has an increased length compared to conventional effusion cooling apertures and hence has a greater internal surface area for the coolant to extract heat from the component. The effusion cooling apertures may be positioned downstream of mixing, or dilution, ports in combustion chamber walls to rapidly regenerate a film of coolant on the second surface of the wall.

The use of the double wall cooled component has shown a 100° C. temperature benefit compared to conventionally cooled components, e.g. with conventional impingement cooling apertures in one wall and conventional effusion cooling apertures in a second wall.

Each effusion cooling aperture has a diagonal slotted inlet, a metering portion to throttle and control the flow of coolant into the inlet, and an aerodynamic diffusion portion which has a layback angle to angle the coolant more closely onto the surface of the wall of the cooled component.

Although the present disclosure has been described with reference to effusion cooling apertures with rectangular shape, square shape, isosceles trapezium shape and rhombus shape outlets it may be possible to use parallelogram shapes or any other suitable quadrilateral shape.

The cooled components comprise a superalloy, for example a nickel, or cobalt, superalloy. The use of the effusion cooling apertures of the present disclosure may enable less temperature resistant superalloys to be used to manufacture the cooled component and hence reduce the cost of the cooled component or alternatively enable the high temperature resistant superalloys used to manufacture cooled components to operate at higher temperatures.

The cooled component may be a turbine blade, a turbine vane, a combustion chamber wall, a combustion chamber tile, a combustion chamber heat shield, a combustion chamber wall segment or a turbine shroud.

The cooled component may be a gas turbine engine component or other turbomachine component, e.g. a steam turbine, or an internal combustion engine etc.

The gas turbine engine may be an aero gas turbine engine, an industrial gas turbine engine, a marine gas turbine engine or an automotive gas turbine engine. The aero gas turbine engine may be a turbofan gas turbine engine, a turbo-shaft gas turbine engine, a turbo-propeller gas turbine engine or a turbojet gas turbine engine.

The invention claimed is:

1. A cooled component comprising:

a wall having a first surface and a second surface, the wall having a plurality of effusion cooling apertures extending there-through from the first surface to the second surface;

each effusion cooling aperture of the plurality of effusion cooling apertures having:

an inlet in the first surface;

an outlet in the second surface; and a metering portion and a diffusing portion arranged in flow series from the inlet to the outlet, the metering portion being elongate and having a width and length, the width of the metering portion being greater than the length of the metering portion, the metering portion of said each effusion cooling aperture comprising:

an inlet portion;

a longitudinally upstream extending portion that extends from the inlet portion longitudinally toward an upstream end of the wall;

a U-shaped bend portion having an upstream wall and a downstream wall curving along a same direction; and a longitudinally downstream extending portion that extends from the U-shaped bend portion longitudinally toward a downstream end of the wall, wherein:

the longitudinally upstream extending portion is defined by a first upper surface, a first lower surface and two side surfaces, each of the two side surfaces respectively connecting the first upper surface and the first lower surface;

the longitudinally downstream extending portion is defined by a second upper surface different from the first upper surface, a second lower surface different from the first lower surface and another two side surfaces, each of the other two side surfaces respectively connecting the second upper surface and the second lower surface;

the inlet of said each effusion cooling aperture is downstream of the U-shaped bend portion;

the outlet of said each effusion cooling aperture is downstream of the U-shaped bend portion;

the U-shaped bend portion of said each effusion cooling aperture is a most upstream portion of said each effusion cooling aperture with respect to the upstream end of the wall;

the diffusing portion of said each effusion cooling aperture is arranged at an angle to the second surface; and each outlet has a quadrilateral shape in a plane of the second surface of the wall.

2. The cooled component as claimed in claim 1, wherein the outlet of said each effusion cooling aperture has a shape selected from the group consisting of a rectangular shape, a parallelogram shape, a rhombus shape and an isosceles trapezium shape.

3. The cooled component as claimed in claim 2, wherein:

the outlet of said each effusion cooling aperture has a rectangular shape; and the outlet of said each effusion cooling aperture is arranged such that two sides of the rectangular shape extend laterally and two sides of the rectangular shape extend longitudinally.

4. The cooled component as claimed in claim 2, wherein:

the outlet of said each effusion cooling aperture has a rhombus shape or an isosceles trapezium shape; and the outlet of said each effusion cooling aperture is arranged such that two sides of the rhombus or isosceles trapezium shape extend laterally and two sides of the rhombus or isosceles trapezium shape extend longitudinally and laterally.

5. The cooled component as claimed in claim 1, wherein:

the inlet of said each effusion cooling aperture has a curved upstream end wall, a curved downstream end wall and curved side walls;

the curved upstream end wall is concave;

the curved downstream end wall is convex; and the curved side walls are concave.

6. The cooled component as claimed in claim 5, wherein the curved upstream and downstream end walls diverge in a longitudinal, axial, direction of the wall.

7. The cooled component as claimed in claim 1, wherein:

the plurality of effusion cooling aperture are arranged in longitudinally spaced rows; and the plurality of effusion cooling aperture in each row are laterally spaced apart.

8. The cooled component as claimed in claim 7, wherein the plurality of effusion cooling aperture in each row are offset laterally from the plurality of effusion cooling aperture in each adjacent row.

9. The cooled component as claimed in claim 1, wherein a ratio of the width of the metering portion to the length of the metering portion is from 3 to 1 to 8 to 1.

10. The cooled component as claimed in claim 1, wherein the metering portion is arranged at an angle of between 10° and 20° to the second surface.

11. The cooled component as claimed in claim 1, wherein:

the first surface is corrugated; and corrugations in the first surface are longitudinally spaced.

12. The cooled component as claimed in claim 11 wherein the U-shaped bend portion of the metering portion of each effusion cooling aperture is aligned longitudinally with a corresponding one of the corrugations in the first surface of the wall.

13. The cooled component as claimed in claim 1, wherein:

the first surface has a plurality of rows of bulges;

the bulges in each row of the plurality of rows are laterally spaced; and the plurality of rows of bulges are longitudinally spaced.

14. The cooled component as claimed in claim 13, wherein a junction between the longitudinally upstream extending portion and the U-shaped bend portion of the metering portion of each effusion cooling aperture is aligned laterally and longitudinally with a point of a corresponding bulge of the bulges in the first surface of the wall, the point being at a maximum distance of the first surface from the second surface of the wall.

15. The cooled component as claimed in claim 1, wherein:

the length of the metering portion of the plurality of effusion cooling aperture is 0.3 mm;

the width of the metering portion of the plurality of effusion cooling aperture is 0.9 mm;

the longitudinally upstream extending portion and the longitudinally downstream extending portion of the metering portion of the plurality of effusion cooling aperture are arranged at an angle of 12° to the second surface; and a surface of the diffusing portion of the effusion cooling apertures is arranged at an angle of 12° to the second surface to form the diffusing portion.

16. The cooled component as claimed in claim 1, wherein:

the length of the metering portion of the plurality of effusion cooling aperture is 0.3 mm;

the width of the metering portion of the plurality of effusion cooling aperture is 0.9 mm;

the longitudinally upstream extending portion and the longitudinally downstream extending portion of the metering portion of the plurality of effusion cooling aperture are arranged at an angle of 17° to the second surface; and a surface of the diffusing portion of the plurality of effusion cooling aperture is arranged at an angle of 17° to the second surface to form the diffusing portion.

17. The cooled component as claimed in claim 1, wherein:

the cooled component comprises a second wall, the second wall having a third surface and a fourth surface;

the fourth surface of the second wall is spaced from the first surface of the wall; and the second wall has a plurality of impingement cooling apertures extending there-through from the third surface to the fourth surface.

18. The cooled component as claimed in claim 17, wherein:

the length of the metering portion of the plurality of effusion cooling aperture is 0.3 mm; and the width of the metering portion of the plurality of effusion cooling aperture is 2.4 mm;

the longitudinally upstream extending portion and the longitudinally downstream extending portion of the metering portion of the plurality of effusion cooling aperture are arranged at an angle of 16° to the second surface; and a surface of the diffusing portion of the effusion cooling aperture is arranged at an angle of 16° to the second surface to form the diffusing portion.

19. The cooled component as claimed in claim 17, wherein at least some of the plurality of impingement cooling apertures in the second wall are aligned with corrugations in the first surface of the wall.

20. The cooled component as claimed in claim 17, wherein at least some of the plurality of impingement cooling apertures in the second wall are aligned with bulges in the first surface of the wall.

21. The cooled component as claimed in claim 1, wherein the cooled component is selected from the group consisting of a turbine blade, a turbine vane, a combustion chamber wall, a combustion chamber tile, a combustion chamber heat shield, a combustion chamber wall segment and a turbine shroud.

22. The cooled component as claimed in claim 21, wherein:

the cooled component is an annular combustion chamber wall;

the outlet of said each effusion cooling aperture has a rectangular shape; and the annular combustion chamber wall has the outlet of said each effusion cooling aperture arranged such that two first sides of the rectangular shape which extend laterally extend circumferentially of the annular combustion chamber wall and two second sides of the rectangular shape which extend longitudinally extend axially of the annular combustion chamber wall.

23. The cooled component as claimed in claim 21, wherein:

the cooled component is a combustion chamber tile for an annular combustion chamber wall;

the outlet of said each effusion cooling aperture has a rectangular shapes; and the combustion chamber tile has the outlet of said each effusion cooling aperture arranged such that two first sides of the rectangular shape which extend laterally extend circumferentially of the combustion chamber tile and two second sides of the rectangular shape which extend longitudinally extend axially of the combustion chamber tile.

24. The cooled component as claimed in claim 21, wherein:

the cooled component is a combustion chamber wall segment for an annular combustion chamber wall, the combustion chamber wall segment comprises an outer wall and an inner wall spaced from the outer wall;

the outer wall has a plurality of impingement cooling apertures;

the inner wall has a plurality of effusion cooling apertures;

the outlet of said each effusion cooling aperture has a rectangular shape; and the inner wall has the outlet of said each effusion cooling aperture arranged such that two first sides of the rectangular shape which extend laterally extend circumferentially of the combustion chamber wall segment and two second sides of the rectangular shape which extend longitudinally extend axially of the combustion chamber wall segment.

25. The cooled component as claimed in claim 21, wherein:

the cooled component is a turbine blade or turbine vane;

the outlet of said each effusion cooling aperture has a rectangular shape; and the turbine blade or turbine vane has the outlet of said each effusion cooling aperture that has a rectangular shape and is arranged such that two first sides of the rectangular shape which extend laterally extend radially of the turbine blade or turbine vane, and two second sides of the rectangular shape which extend longitudinally extend axially of the turbine blade or turbine vane.

26. The cooled component as claimed in claim 1, wherein the cooled component comprises a superalloy.

27. The cooled component as claimed in claim 1, wherein the cooled component is manufactured by additive layer manufacturing.

28. The cooled component as claimed in claim 1, wherein the cooled component is selected from a group consisting of a gas turbine engine component, a turbomachine component and an internal combustion engine component.

29. The cooled component as claimed in claim 1, wherein the longitudinally upstream extending portion and the longitudinally downstream extending portion of each effusion cooling aperture are substantially parallel.

30. The cooled component as claimed in claim 1, wherein:

the inlet of said each effusion cooling aperture of each effusion cooling aperture has an elongate shape in a plane of the first surface of the wall; and the inlet of said each effusion cooling aperture in the first surface of the wall is a diagonally slotted inlet that is arranged diagonally with respect to the outlet in the second surface.

31. The cooled component as claimed in claim 1, wherein the U-shaped bend portion of the metering portion has the upstream wall that is convex and the downstream wall that is concave.

32. The cooled component as claimed in claim 1, wherein the inlet of said each effusion cooling aperture is downstream of a downstream end of the longitudinally downstream extending portion of the metering portion with respect to the downstream end of the wall.

33. The cooled component as claimed in claim 32, wherein an end of the inlet of said each effusion cooling aperture is aligned longitudinally with an end of the outlet with respect to a longitudinal direction of the second surface.

34. The cooled component as claimed in claim 1, wherein the longitudinally upstream extending portion and the longitudinally downstream extending portion are spaced apart in a thickness direction of the wall such that a portion of the wall is directly sandwiched by the longitudinally upstream extending portion and the longitudinally downstream extending portion in the thickness direction of the wall.

* * * * *